US005458032A

United States Patent [19]

Spiegelberg

[11] Patent Number: 5,458,032

[45] Date of Patent: Oct. 17, 1995

[54] METHOD FOR MAKING A COLD FORGED BATTERY BUSHING

[75] Inventor: Bernard N. Spiegelberg, Germantown, Wis.

[73] Assignee: Tulip Corporation, Milwaukee, Wis.

[21] Appl. No.: 149,460

[22] Filed: Nov. 9, 1993

[51] Int. Cl.[6] ..... B26D 3/00

[52] U.S. Cl. ..... 83/23; 83/54; 83/267; 83/405; 83/733

[58] Field of Search ..... 83/23, 54, 84, 83/267, 405, 410.9, 411.7, 685, 733

[56] References Cited

U.S. PATENT DOCUMENTS

| | | | |
|---|---|---|---|
| 1,994,178 | 3/1935 | Raiche | 83/267 X |
| 2,566,243 | 8/1951 | Nyquist | 83/267 X |
| 4,197,772 | 4/1980 | Anderson et al. | 83/411.7 |
| 4,776,197 | 10/1988 | Scott | 72/355.6 |
| 4,945,749 | 8/1990 | Walker et al. | 72/356 |
| 5,048,590 | 9/1991 | Carter | 164/120 |
| 5,296,317 | 3/1994 | Ratte et al. | 429/178 |

*Primary Examiner*—Rinaldi I. Rada
*Assistant Examiner*—Raymond D. Woods
*Attorney, Agent, or Firm*—Foley & Lardner

[57] ABSTRACT

An apparatus and method for punching a hole in the end of a battery terminal bushing having a head at one end, a frustum at the other end and a spline ring intermediate the head and the frustum, the bushing including a tapered recess and terminating at a blank wall or disc at the end of the frustum, the apparatus including a base having a plate mounted with a number of openings equally spaced around the perimeter thereof, the plate being mounted on the base for rotary motion with respect to a punch assembly aligned with the path of motion of the opening, the punch assembly including a punch for removing the blank disc at the end of the frustum, and passing the punch through the tapered recess in the bushing and the opening in the plate.

7 Claims, 3 Drawing Sheets

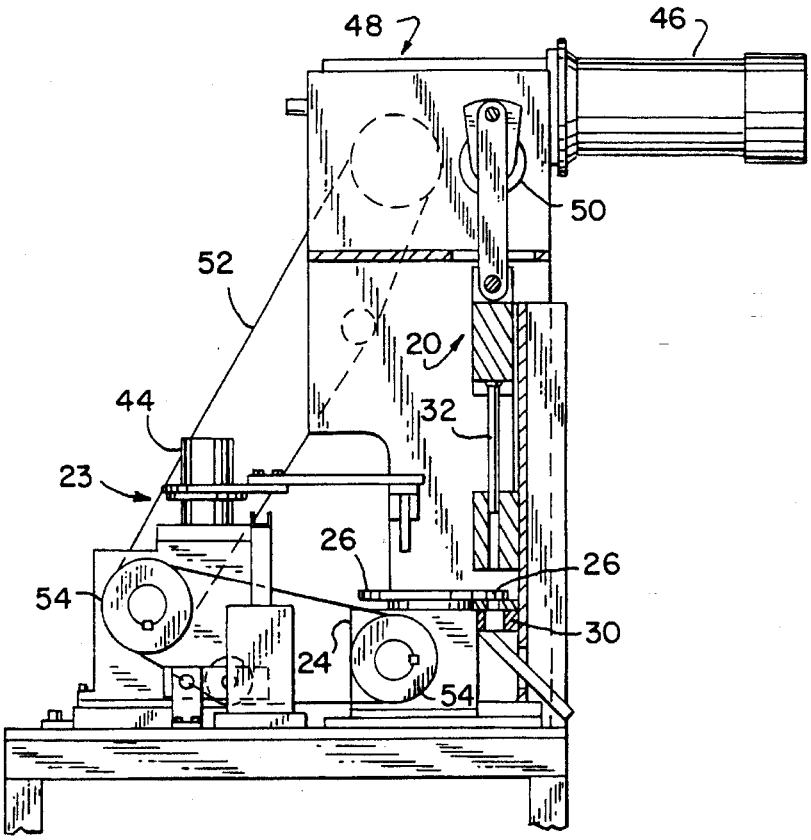
FIG. 3
FIG. 4
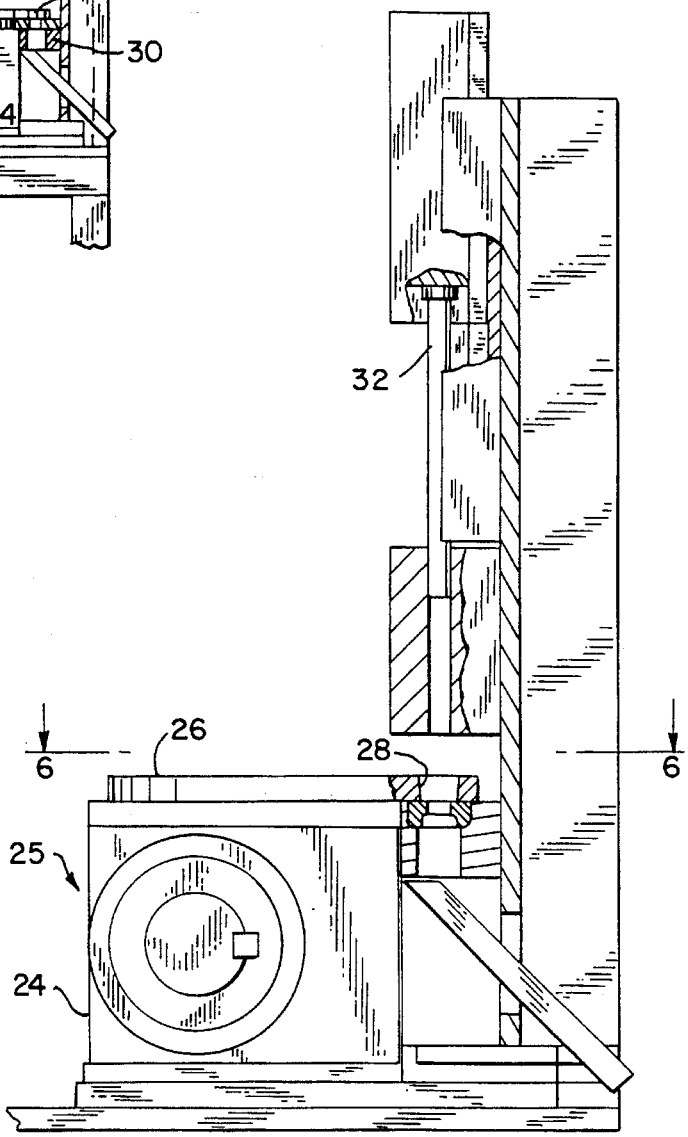
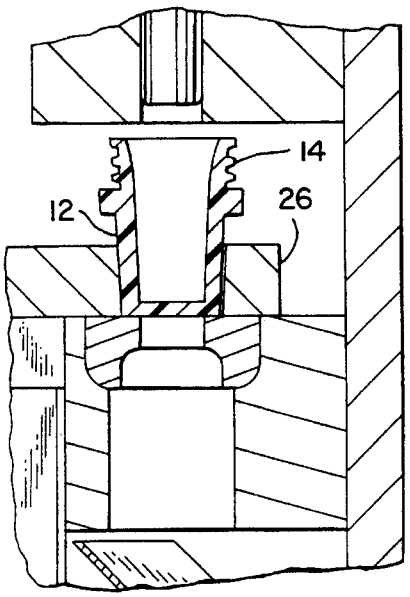
FIG. 7

FIG. 5
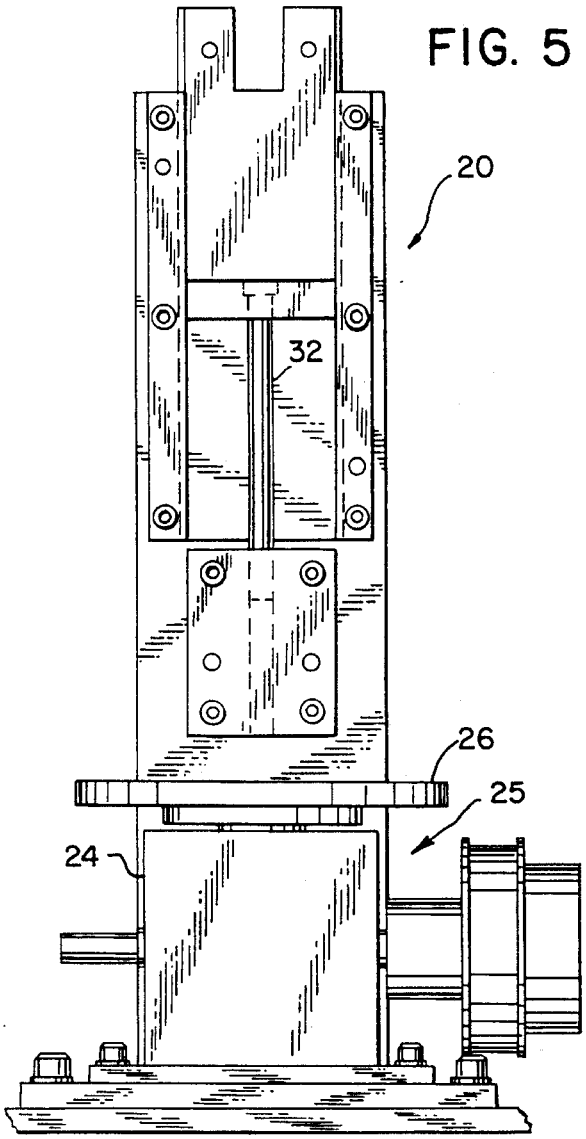
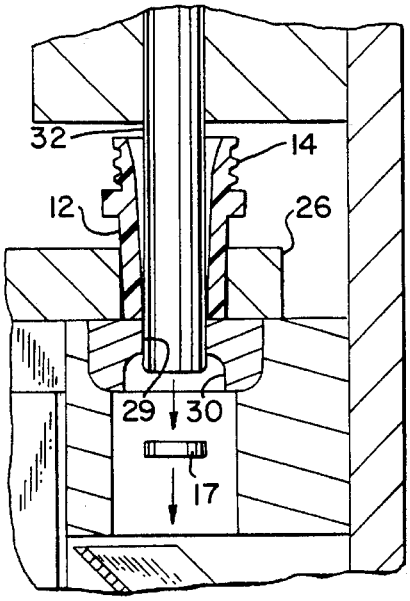
FIG. 8
FIG. 9
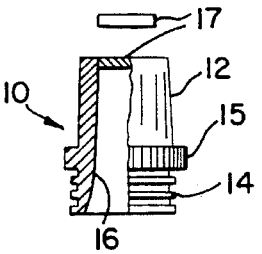
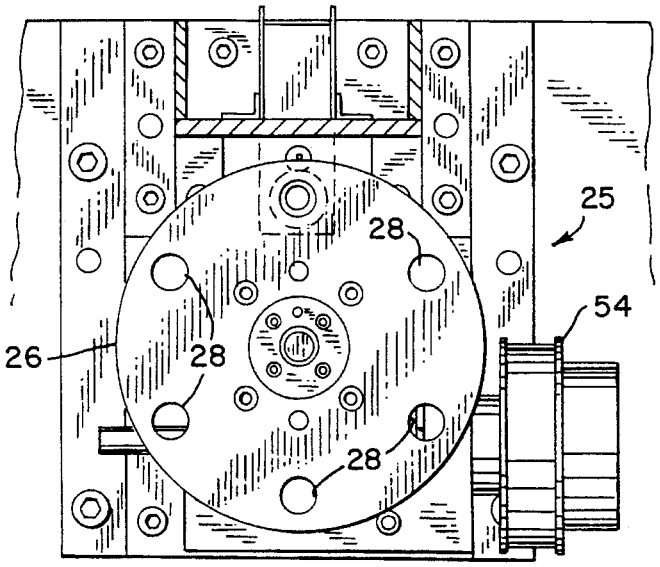
FIG. 6

METHOD FOR MAKING A COLD FORGED BATTERY BUSHING

FIELD OF THE INVENTION

The present invention relates to cold forged lead battery bushings of the type mounted on storage battery terminals and more particularly to an apparatus and method for removing the blank end of a cold forged battery bushing.

BACKGROUND OF THE INVENTION

In U.S. Pat. No. 4,776,197, entitled "Process And Apparatus For Producing An Electrical Battery Pole Or Terminal," issued on Oct. 11, 1988, to Giorgio Scott, a process is described for producing lead automotive battery terminal bushings that are oversize in length. Both ends of the bushing are formed about 0.200" longer than required. A second processing step is required for blanking or milling both ends of the semi-finished bushing after removal from the dies so as to form a hole through the finished battery bushing. The excess lead on each end of the bushing is first sawed off and a second operation is required to face the ends to size and to produce a better finished surface. This machining operation requires a rigid and accurate machine to hold the tolerances at each end of the bushing in order to maintain a good finish and to keep up with the production of the terminals during the first process. The excess material required in the first stage of manufacture is approximately 25% which is turned into chips and shavings that must be treated as hazardous material, thus requiring a vacuum system and a bag house filter system to clean the airstream and remove the lead fines in order to maintain environmental requirements.

SUMMARY OF THE PRESENT INVENTION

The present invention contemplates the formation of a lead battery terminal bushing by the process as described above. However, rather than forming the terminal bushing with an oversize length, the bushing blank is formed to the required finished size for mounting directly on the battery terminal. This has been achieved by providing an internal cavity in the bushing, in the form of a tapered recess which terminates short of the upper end of the bushing. The closed end of the tapered recess in the interior of the terminal bushing is opened by passing the bushing through a punch assembly to punch the blank out of the closed end of the bushing. With this system 25% more finished bushings per roll of extruded lead is achieved than produced by the Scott process described above.

A further advantage of this system is the elimination of any environmental problems in the handling, machining, and filtering of extremely hazardous material.

Another important advantage of the present invention is the forming of a lead battery terminal bushing in a die to finish size requirements thereby eliminating further machining of the bushing.

A further advantage is the elimination of the expense of a machining fixture which is replaced by a simple one station punch at one-fifth the cost of the Scott process. In this regard the blank that is punched out of the top of the terminal is one solid piece about 1/16" thick which can be remelted for reprocessing on site.

Other principal features and advantages of the invention will become apparent to those skilled in the art upon review of the following drawings, the detailed description and the appended claims.

BRIEF DESCRIPTION OF THE DRAWINGS

FIG. 3 is a side view of the punch machine;

FIG. 4 is an enlarged view of a portion of the punch machine partly broken away to show the punch;

FIG. 5 is an enlarged front view of the punch;

FIG. 6 is a view taken on line 6—6 of FIG. 4;

FIG. 7 is an enlarged cross section punch shown aligned with a bushing;

FIG. 8 is a view similar to FIG. 7 showing the punch aligned in the bushing; and FIG. 9 is a side view partly in section of the terminal bushing according to the present invention.

Figure 1:
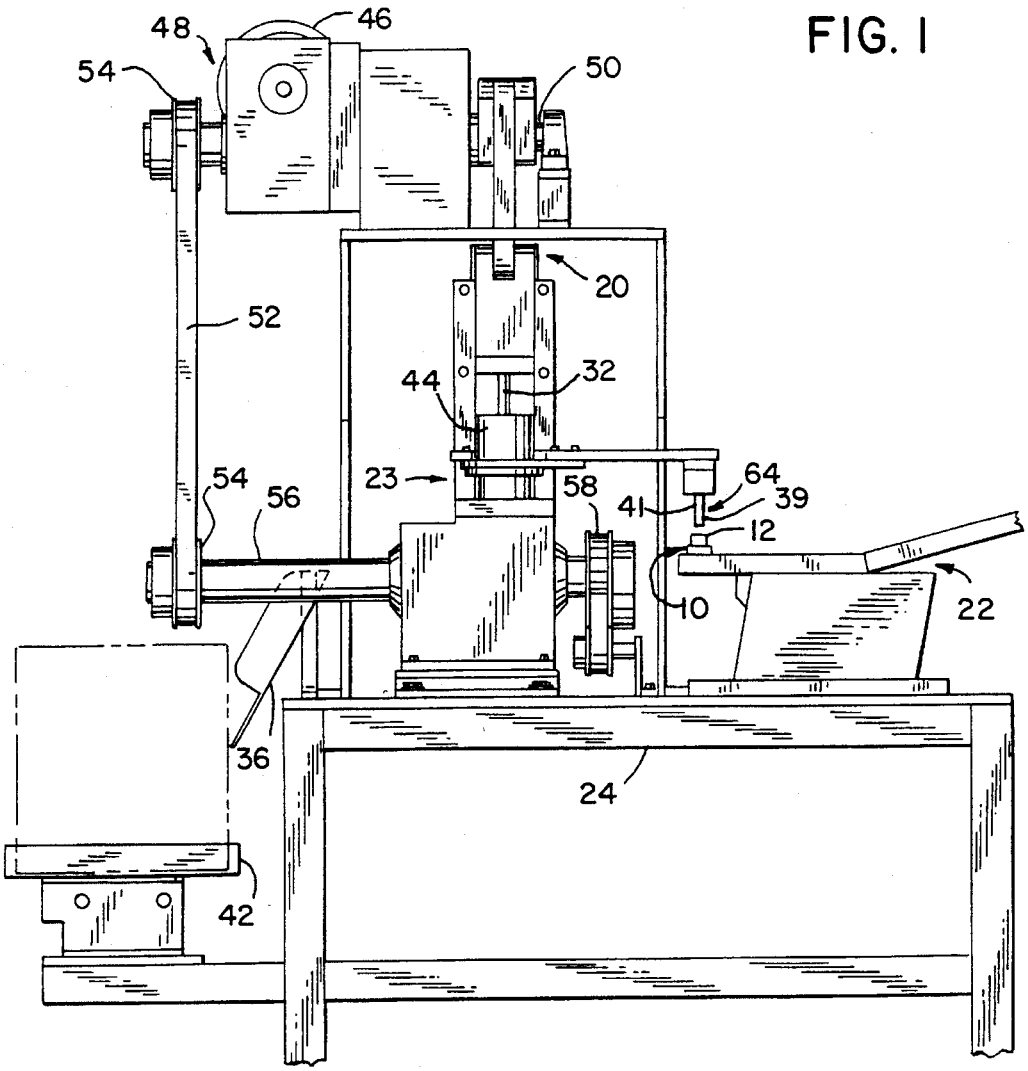
FIG. 1 is a side view of the bushing pick and place punch machine according to the present invention.
Figure 2:
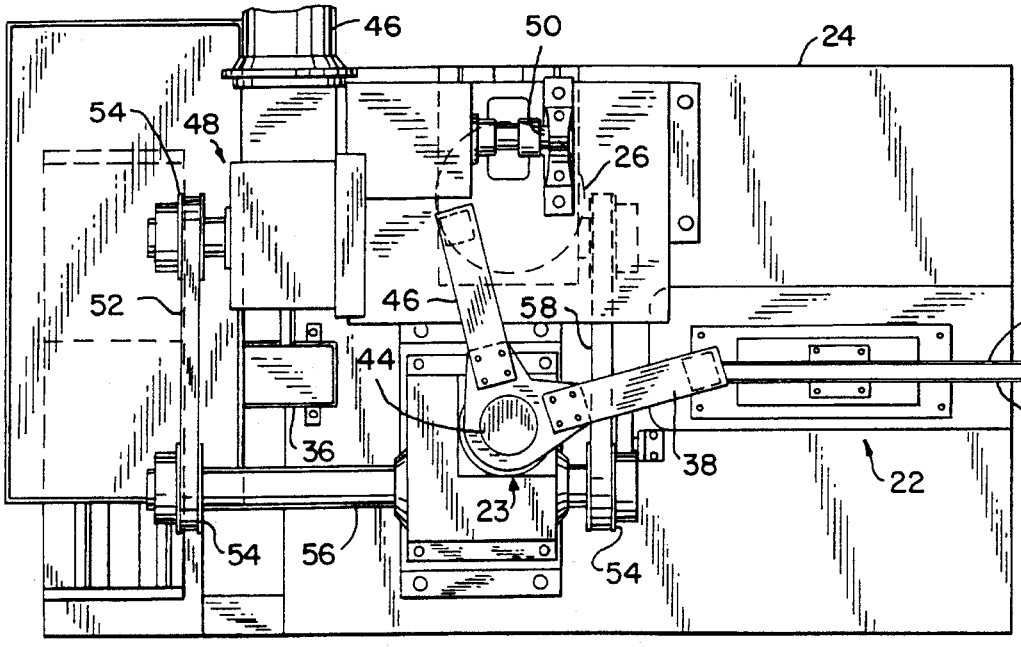
FIG. 2 is a top view of the punch machine shown in FIG. 1.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

A terminal bushing 10 of the type contemplated herein is shown partly in cross section in FIG. 9. The bushing 10 includes a frustum 12 and a fluted head 14 which are separated by a splined ring 15. A tapered recess 16 is provided in the bushing which terminates at a blank wall or disc 17 at the end of the tapered recess 16. The blank wall 17 at the end of the recess 16 must be removed in order to mount the bushing 10 onto a battery terminal as generally understood in the art. This is accomplished by means of a punch assembly 20 and a pick and place indexer 23 of the type manufactured by Commercial Cam Co., Inc. (CAMCO), of Wheeling, Ill., which are mounted on a support frame or table 24.

The terminal bushings 10 are transferred from a die assembly of the type shown and described in U.S. Pat. No. 4,776,197, to a vibrating type hopper 22 having side walls 19 which are spaced apart a distance less than the diameter of the ring 15. The frustum 12 is heavier than the head 14 and therefore will be suspended downwardly in the hopper 22. The ring 15 of the terminal bushing will ride or slide along the top of the side walls 19 of the hopper. The hopper is angled downward and is vibrated so that the bushings slide toward the end of the hopper.

The bushings 10 are picked up from the hopper 22 by the pick and place assembly 23 and deposited in an index plate assembly 25 for movement toward punch assembly 20 as shown in the drawings. The index assembly 25 generally includes a base 24 for supporting a circular index plate 26 which is mounted for rotary motion on the base 24. The plate 26 includes a number of openings 28 around the perimeter, equally spaced from the axis of the plate and from each other. The openings 28 are tapered as shown in FIG. 4 and sized to receive the frustum 12 of the bushing 10. In this regard, it should be noted that the openings 28 are tapered to conform to the taper of the frustum 16 and preferably slightly smaller so that the end of the frustum 16 does not extend below the bottom of the plate 26 as shown in FIG. 8.

The punch assembly 20 is mounted in overhanging relationship to the edge of the plate 26 and in alignment with the path of travel of the openings 28 in the plate 26. The punch assembly 20 generally includes a punch 32 which is located vertically above the plate 26 so that it will pass through the openings 28 when actuated. A steel anvil 30 having an opening 29 is mounted on base 24 below the plate 26 in the path of travel of openings 28. The opening 29 in the anvil corresponds to the size of the punch 32 so that the disc 17 is punched through the opening 29 in the anvil 30 for discharge into a chute 31.

The bushings 10 are picked up from the hopper 22 by the pick and place assembly 23 and placed in the opening 28 in plate 26 and simultaneously picked up from the plate 26 and deposited into a chute 36 for discharge into a storage bin 42. In this regard, the assembly 23 includes a pair of pick up arms 38 and 40. The arm 38 transfers the terminal bushings 10 from the hopper 22 to the openings 28 in the plate 26. The arm 40 picks up the bushings 10 from the openings 28 in the plate 26 for transfer to the chute 36. The arms 38 and 40 are fixed in an angular relation on a spindle 44 which is mounted for vertical and rotary movement in assembly 23. The arm 38 will move a terminal bushing 10 from the end of the hopper 22 to one of the openings 28 in the plate 26 and at the same time the arm 40 will pick up a terminal bushing 10 from one of the openings 28 in the plate 26 for deposit in chute 36. The common spindle 44 which is moved vertically from a pick up position and rotated to simultaneously transfer a bushing 10 to the plate 26 and a finished bushing from the plate 26 to chute 36.

Each of the arms 38 and 40 has an air actuated finger clamp assembly 64 mounted on the end thereof. Each clamp assembly includes a semi-circular member 39 and a latch member 41. When the arms 38 and 40 are rotated to a pick up position, the spindle 44 will drop the arms so that the members 39 and 41 are aligned with the head 12 of a terminal bushing at the end of the hopper 22 and a terminal bushing in one of the openings 28 in the plate 26. The clamps 39 and 41 are actuated to close on the head 12 of the bushings. The arms 38 and 40 are raised by the spindle 44 to clear the bushings 10 from the hopper 22 and the plate 26. The spindle is rotated to align the first arm 38 with one of the holes 28 in the plate 26 and the second arm 40 is rotated over the chute 36. The spindle is dropped so that the terminal bushing in the arm 38 is aligned in an opening 28 in the plate 26 and the terminal bushing in the second arm is suspended over the chute 36. The clamps are opened to release the bushings and the spindle 44 elevated to repeat the cycle. Once the bushings are released the plate 26 is indexed one step, moving a terminal bushing under the punch 32 and a terminal bushing under the end of the second arm 40.

The punch 32 is driven by a motor 46 through a gear box 48 to provide one punch stroke in each revolution of the shaft 50. The indexer 23 is driven off of gear box 48 by a belt 52 mounted on a pulley 54 on the end of shaft 56. The plate assembly 25 is driven by a belt 58 in timed sequence with the movement of the pick and place assembly 23. In this regard, the arms 38 and 40 simultaneously pick up a bushing from the hopper 22 and the plate 26 and rotated to a position to place a bushing in the plate and to drop a bushing into chute 36 for deposit into storage bin 42. The spindle 44 is dropped and the clamps opened to release the bushing simultaneously with the movement of the arms 34 and 40, the punch cycles to punch the disc out of the end of the bushing. The punch is withdrawn from the bushing and the plate stepped to align the next bushing with the punch. The arms 38 and 40 are dropped to pick up a bushing from the hopper and a bushing from the plate during the punching movement of the punch. The arms 38 and 40 are raised, rotated and lowered to position the bushings in the plate and to drop a finished bushing into the chute. The arms are raised and the plate is cycled to align the next bushing with the punch. The cycle is then repeated.

Thus, it should be apparent that there has been provided in accordance with the present invention an improved cold forged battery bushing that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A method for punching a hole through one end of a cold forged battery bushing having a frustum at one end and a tapered recess in the frustum which terminates at a blank wall, the method comprising the steps of dropping the cold forged bushing into a hopper, transferring the bushing from the hopper to a plate, rotating the plate to align the bushing with a punch, actuating the punch to knock out the blank wall at the end of the recess, rotating the plate to move the bushing away from the punch, and transferring the bushing from the plate to a hopper.

2. The method according to claim 1 including the step of vibrating the hopper to align the bushing with one end of the hopper for transfer to the plate.

3. The method according to claim 2 including placing said bushing in a tapered opening in said plate which conforms to the dimensions of said frustum during the transferring step.

4. The method according to claim 3 including the step of placing an anvil having an opening corresponding to the size of the punch in alignment with the punch and the opening in the plate.

5. A method for punching a hole in an electrical battery bushing having a head at one end, a frustum at another end and a spline ring between the head and the frustum, the bushing including a tapered recess terminating at a blank disc at the one end of the frustum, the method comprising the steps of dropping the bushing into a hopper having a bottom and a slot in the bottom of the hopper, allowing the frustum to drop through the slot in the hopper, picking the bushing up from one end of the hopper, transferring the bushing to a plate having a plurality of tapered openings equally spaced around the perimeter thereof, aligning the frustum in one of the tapered openings in the plate and punching the disc out of the one end of the frustum.

6. The method according to claim 5 including the step of vibrating the hopper to align the bushing at one end of the slot in the hopper.

7. The method according to claim 6 including the step of placing an opening of an anvil in alignment with one of the openings in the plate.

* * * * *